US005455078A

United States Patent [19]

Kanzaki

[11] Patent Number: 5,455,078

[45] Date of Patent: Oct. 3, 1995

[54] METHOD OF ROUGHENING AND COATING THE CONTACT SURFACE OF A VALVE LIFTER

[75] Inventor: Tatsuo Kanzaki, Yamato, Japan

[73] Assignee: Fuji Oozx Inc., Japan

[21] Appl. No.: 96,966

[22] Filed: Jul. 27, 1993

[30] Foreign Application Priority Data

Mar. 26, 1993 [JP] Japan ..... 5-090509

[51] Int. Cl.[6] ..... B24C 1/00; B05D 1/08

[52] U.S. Cl. ..... 427/446; 427/456; 427/328; 451/38; 451/39

[58] Field of Search ..... 51/319–320; 427/446, 427/456, 328; 451/38, 39

[56] References Cited

U.S. PATENT DOCUMENTS 3,188,776 6/1965 Dill ..... 51/320

FOREIGN PATENT DOCUMENTS 59-134662 8/1984 Japan ..... 51/319

63-256362 10/1988 Japan ..... 51/319

2-185370 6/1990 Japan ..... 51/319

952975 8/1982 U.S.S.R. ..... 51/320

OTHER PUBLICATIONS

Thermal Spraying: Practice, Theory, and Application, American Welding Society, 1985, pp. 18–23.

*Primary Examiner*—Shrive Beck
*Assistant Examiner*—Katherine A. Bareford
*Attorney, Agent, or Firm*—Zarley, McKee, Thomte, Voorhees & Sease

[57] ABSTRACT

After primary blasting is applied to the outer circumferential surface of a cylindrical valve lifter the upper end of which is closed with an abrasive to form a rough surface, a secondary blasting is applied to the rough surface with an abrasive which has particle size smaller than that of the first abrasive. Smaller irregularities are formed on the rough surface, and a coated layer is formed by thermal spraying on the surface, thereby increasing adhesive strength of the coated layer by anchoring effect.

3 Claims, 2 Drawing Sheets

METHOD OF ROUGHENING AND COATING THE CONTACT SURFACE OF A VALVE LIFTER

BACKGROUND OF THE INVENTION

The present invention relates to a method of treating the surface of a valve lifter, and particularly, to a method of coating the outer circumferential surface of the valve lifter moulded from aluminium or its alloy, with wear resistant material.

In a valve lifter or tappet for use in a direct acting valve gear of an internal combustion engine, its body was conventionally moulded from iron such as steel or cast iron. Recently, in order to make the valve gear lightened, an Al alloy valve lifter has been used.

However, such an Al alloy valve lifter has lower mechanical strength and wear resistance than an iron lifter, so that an Al alloy cylinder which has the valve lifter allows sliding faces to wear earlier or brings about scoring. To prevent such disadvantages, the outer circumferential surface of the Al alloy valve lifter is coated with wear resistant material different from the base material. In this respect, it is necessary to increase adhesiveness of wear resistant material, thereby increasing adhesion strength to the base material. There is a method of coating the surface to form a rough surface and treating the surface with wear resistant material. To form the rough surface, before surface treatment such as thermal spraying is made, blasting is conventionally made with grit which has relatively large particle size.

Recently, allowable rotation speed and maximum brake power of an engine have been inclined to increase, and stress which acts on the circumferential surface of a valve lifter, such as bending or shearing stress, becomes excessive. A valve lifter in which the above Al alloy base material is coated with wear resistant material on the outer circumferential surface requires high adhesion strength at the coated layer.

However, in the above surface treating method by spraying after a single blasting, the coated layer has insufficient adhesion strength.

It is an object of the present invention to solve the above disadvantages and to provide a method of treating the surface of a valve lifter in which adhesiveness of a coated layer to base material is improved to increase adhesion strength, thereby providing a durable reliable valve lifter.

SUMMARY OF THE INVENTION

According to the present invention, there is provided a method of treating the surface of a valve lifter the upper end of which is closed, the method comprising the steps of: applying primary blasting to at least the outer circumferential surface of a valve lifter body with a first abrasive to form a rough surface having larger irreguralities; applying secondary blasting to the rough surface with a second abrasive which has particle size smaller than that of the first abrasive to form smaller irregularities on the larger irregularities of the rough surface; and forming a coated layer of wear resistant material on the rough surface.

The abrasive in the primary blasting may be preferably grit which has relatively large particle size, and the abrasive in the secondary blasting may be preferably alumina which has particle size smaller than that of the grit in the primary blasting.

After the primary blasting, the secondary blasting is applied with the lower specific-gravity abrasive which has smaller particle size, whereby the minutely irregular surface is formed on the larger irregularity rough surface formed by the primary blasting. Forming the coated layer on the outer circumferential surface of the valve lifter body by thermal spraying increases adhesiveness of the coated layer by anchoring effect. The present invention improves adhesiveness of the coated layer to the valve lifter body, thereby increasing adhesion strength of the coated layer remarkably and providing a durable reliable valve lifter.

DETAILED DESCRIPTION OF THE PREFERRED EMBODIMENTS

Figure 1:
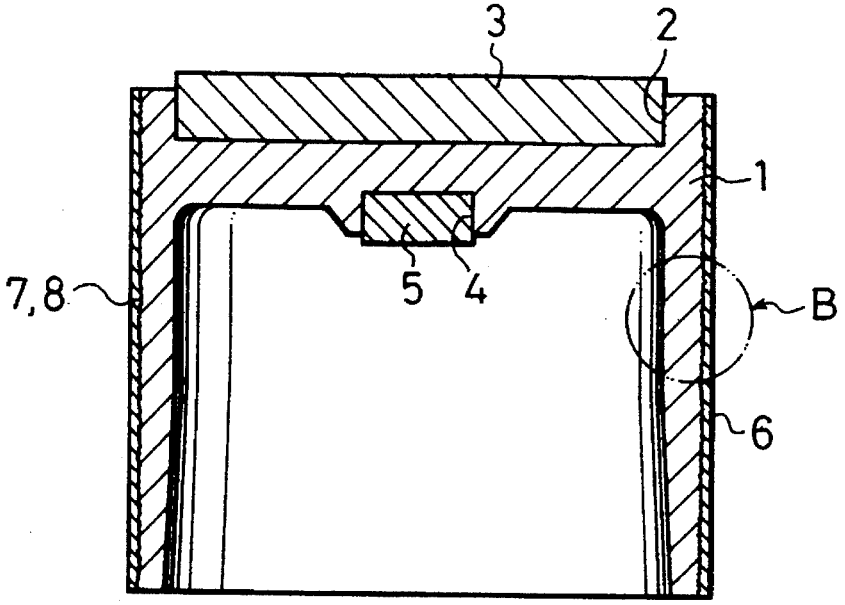
FIG. 1 is a longitudinal sectional view of a valve lifter in accordance with the present invention.

FIG. 1 illustrates a valve lifter formed by a method of the present invention, and a cylindrical valve lifter body 1 the upper end of which is closed is moulded from aluminium or its alloy. In a cylindrical recess 2 formed on the upper surface of the lifter body 1, steel or cast iron wear resistant shim 3 is removably inserted, and cotacts a rotary cam (not shown) at its upper end. A steel or cast iron tip 5 is forcedly inserted in a smaller diameter recess 4 formed in an inner bottom surface of the lifter body 1 and contacts the axial end of an engine valve(not shown).

Figure 2:
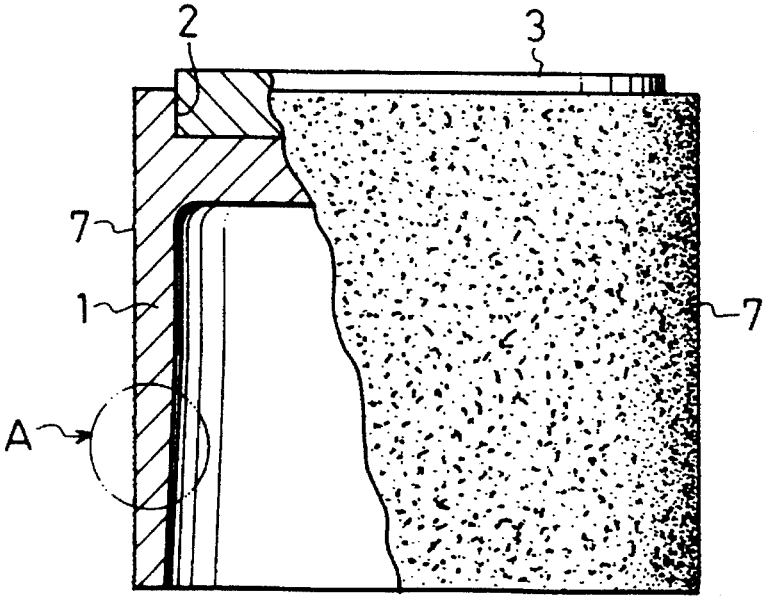
FIG. 2 is a partially cut-away front elevational view of the valve lifter after primary blasting.
Figure 3:
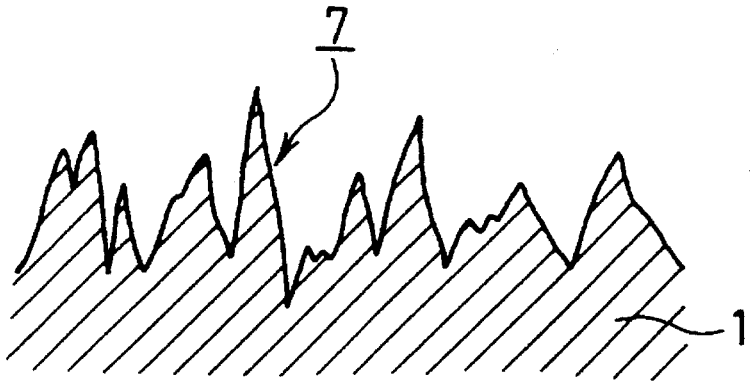
FIG. 3 is an enlarged view of part A as shown in FIG. 2.
Figure 4:
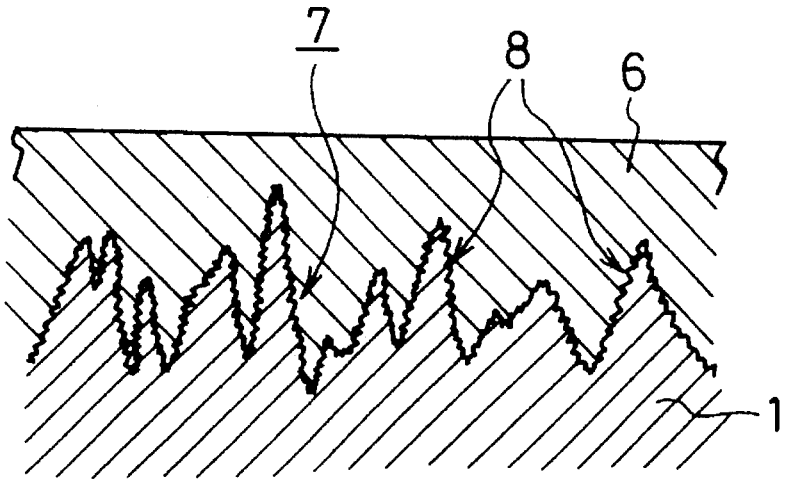
FIG. 4 is an enlarged view of part B as shown in FIG. 1.

A rigid coated layer 6 made of wear resistant metal such as inexpensive iron is formed on the circumferential surface of the lifter body 1 through surface treatment process as below. As shown in FIG. 2, primary blasting is applied to the whole outer circumferencial surface of the lifter body to form a rough surface 7 having relatively large unevenness as shown in FIG. 3. An abrasive for use in the primary blasting is preferably relatively large particle size rigid grit made of, for example, cast steel having particle size of #12 to #40 (2830 μm to 740 μm, respectively). The surface roughness Rz in the treatment may be preferably in the range of 60 to 130 μm. Then, secondary blasting is applied to the surface to which the primary blasting is applied to form a minutely irregular surface having Ra of 2 μm and Rz of 10 μm on the rough surface 7 made by the primary blasting as shown in FIG. 4. Preferably, an abrasive for use in the secondary blasting may be a relatively low specific-gravity alumina which has smaller particle size such as #100 to #240 (210 μm to 95 μm, respectively) not to scrape off irregular portion formed by the above primary blasting.

Finally, onto the irregular surface 8 formed by the secondary blasting, iron wear resistant material is sprayed by thermal spraying such as electric arc and plasma spraying to provide a certain thickness, so that the coated layer 6 is formed on the outer circumferential surface of the lifter body 1 as shown in FIG. 1.

Accordingly, the coated layer 6 formed after the primary and secondary blasting increases the circumferential surface area and makes it more active, thereby improving adhesiveness of the coated layer 6 and remarkably increasing adhesion strength. The directions of the irregularities in the irregular surface 8 are not determined, and anchoring effect by which the smaller irregularities are engaged with larger amplitude irregularities made by the primary blasting increases shear load of the boundary between the lift body 1 and the coated layer 6.

The present invention is not limited to the foregoing Al or Al-alloy valve lifter, but may be applied to an iron valve lifter. A suitable abrasive may be employed for primary and secondary blasting.

The present invention is not limited to the foregoing embodiments. Various modification and changes may be made by person skilled in the art without departing from the scope of appended claims as below:

What is claimed is:

1. A method of treating a surface of a valve lifter an upper end of which is closed, the method comprising:

(a) applying primary blasting to at least an outer circumferential surface of a valve lifter body which is molded from aluminum or an aluminum alloy with a first abrasive which comprises grit to form a roughened surface having coarse irregularities constituting a surface roughness of 60 μm to 130 μm;

(b) applying secondary blasting to the roughened surface with a second abrasive of alumina which has particle sizes smaller than that of the first abrasive in the primary blasting to form smaller surface irregularities constituting a surface roughness of not more than 10 μm on the coarse surface irregularities formed by the primary blasting while maintaining a presence of the coarse irregularities; and (c) forming a coated layer of hard-wearing material on the roughened surface.

2. A method as defined in claim 1 wherein the grit has particle size of #12 to #40 and the alumina has particle size of #100 to #240.

3. A method as defined in claim 1 wherein the coated layer is formed by thermal spraying.

* * * * *